US006116119A

United States Patent [19]

Williams

[11] Patent Number: 6,116,119

[45] Date of Patent: Sep. 12, 2000

[54] SHIFTING MECHANISM FOR REVERSIBLE FRICTION DRIVE

[76] Inventor: Keith S. Williams, 20110 Interlochen La., Troutdale, Oreg. 97060

[21] Appl. No.: 08/684,104

[22] Filed: Jul. 22, 1996

[51] Int. Cl.[7] ..... B25B 13/00

[52] U.S. Cl. ..... 81/59.1; 81/63.2; 192/44

[58] Field of Search ..... 81/59.1, 63.2; 192/44, 45

[56] References Cited

U.S. PATENT DOCUMENTS

| | | | |
|---|---|---|---|
| 4,004,666 | 1/1977 | Hinojosa | 81/59.1 |
| 4,884,478 | 12/1989 | Lieser | 81/59.1 |
| 4,987,803 | 1/1991 | Chern | 81/59.1 |
| 5,136,901 | 8/1992 | Williams | 81/59.1 |

*Primary Examiner*—David A. Scherbel
*Assistant Examiner*—Lee Wilson
*Attorney, Agent, or Firm*—Jack E. Day

[57] ABSTRACT

A reversible drive mechanism for socket wrenches, having a detented selector cap thereon. The socket driving post of the wrench is fixedly attached to a triangular shaft rotatably contained within an internal cylindrical bearing surface, which in contained within the head of the wrench handle. Each face of the triangular shaft is a convex arc-shaped surface, and the cylindrical surface and the convex surfaces create between them three lune-shaped spaces. Each of the convex faces on the triangular shaft has tiltably mounted thereon a U-shaped fixture, which loosely contains within its arms a cylindrical roller. As the selector cap is rotated back and forth between selector positions, each U-shaped fixture tips back and forth on its respective convex face, and shifts the contained roller from one extreme to the other of its respective lune-shaped space. Each roller, when shifted, moves from being closely contained on one side of its lune-shaped space to being closely contained on the other side of its space and, when the wrench handle is rotated, the roller is frictionally wedged between the cylindrical surface and the convex shaft face, forcing the driving post and a socket mounted thereon in the desired direction. The lost motion of the wrench handle is reduced to less than 1½ degrees.

4 Claims, 1 Drawing Sheet

FIG. 1 (PRIOR ART)
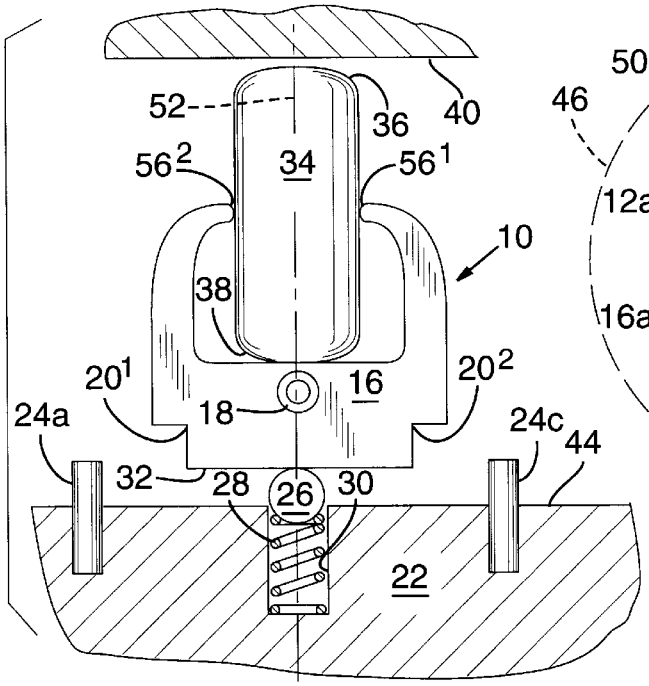
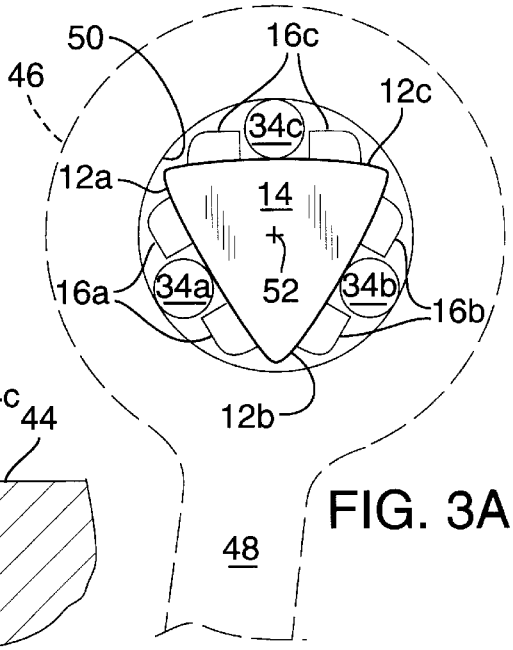
FIG. 3A
FIG. 2 (PRIOR ART)
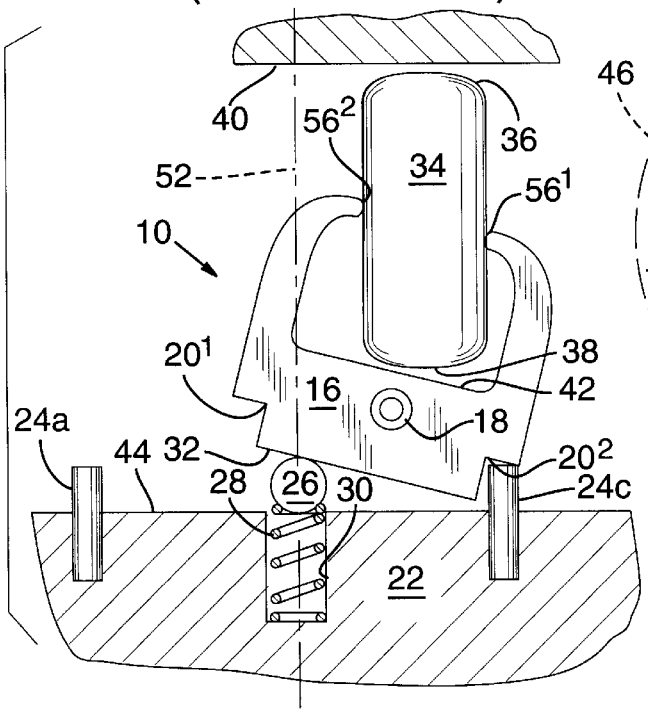
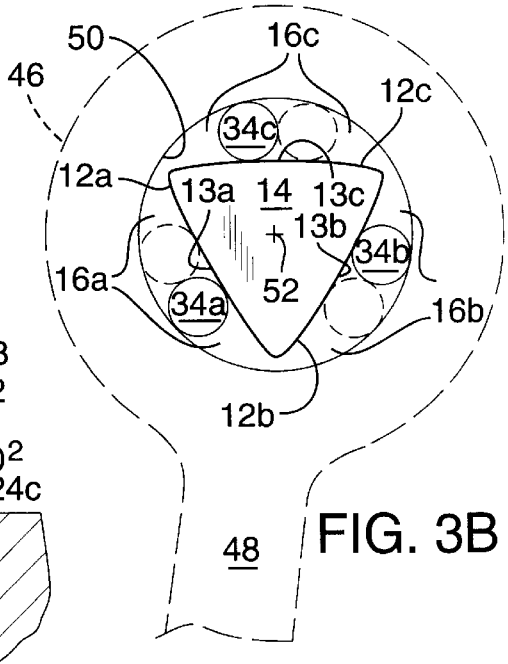
FIG. 3B

SHIFTING MECHANISM FOR REVERSIBLE FRICTION DRIVE

The present invention is, in general, a reversible, nonslip, friction-drive mechanism and, in particular, a novel shifting mechanism for use with nonslip, friction-drive mechanisms for use in drive wrenches for socket tools and the like applications.

BACKGROUND OF THE INVENTION

Numerous attempts have been made to reduce lost motion between gripping positions on reversible drive wrenches for socket wrenches and the like tools. The less lost motion, the tighter the location in which such tools can be used.

Two basic types of reversible drive mechanisms have been developed:

- the ratchet type, which operates on a pawl-and-rack principle; and
- the friction-clutch type, which operates by frictionally engaging rollers between two converging surfaces.

The latter type is the mechanism of the present invention.

Although the ratchet is most widely used, it will not be discussed further here, except to mention that it requires from 10 to 15 degrees between positions of engagement, which limits its use in many situations.

Several modifications have been made of the converging surfaces and roller mechanism. One problem with this type of mechanism is its complexity and the number of parts, making it expensive to manufacture and assemble.

Loomis U.S. Pat. No. 1,136,821 discloses pairs of rollers lodged between the inclined surface of a cam and an internal bearing surface. One or the other of each pair of rollers is wedged between cam and internal bearing surface, depending upon the positioning of the cam, and determining the direction of force to be applied to the socket and its load. It has little specific relationship to the present invention.

Cartwright U.S. Pat. No. 4,669,339 is representative of several mechanisms in which single rollers, constrained to be parallel to the axis of a socket engaging post, are moved into one of two positions where they are frictionally wedged between two converging surfaces to transfer the desired torque from a handle to a socket tool.

Williams U.S. Pat. No. 5,136,901 is by the inventor of the present invention, which is an improvement thereon. The basic difference between the present invention and '901 is that the surface upon which the cylindrical roller moves in the '901 patent is fully planar, whereas in the present invention it is convex or planar only upon the portion of the convex surface closest to the internal bearing surface, reducing the amount of movement required before frictional engagement therebetween.

BRIEF DESCRIPTION OF THE PRESENT INVENTION

The present invention is a friction-clutch mechanism for use with socket wrenches and the like applications. Cylindrical rollers are loosely carried in tilting cages mounted on planar surfaces of an internal post, and are moved into working position between two converging surfaces by a lever and fulcrum structure.

The invention, in the preferred embodiment, provides a novel convex surface upon which roller moves before frictionally engaging said convex surface and an internal bearing surface of the tool handle, the lune-shaped void formed thereby providing a more effective shape for the free movement of said roller. This structure gives essentially no lost motion to provide pressure against a resisting load, such as a bolt or nut, unlike the 10 to 15 degrees or more required by many wrenches to move the handle to a new engagement position, this structure requires a degree or less of movement.

BRIEF DESCRIPTION OF THE DRAWINGS

FIG. 1 is a view of the shifting and clutch mechanism of the present invention, in position for assembly.

FIG. 2 is a view of the shifting and clutch mechanism, showing the roller as shifted into one of two gripping positions, to permit torque to be applied to a resisting element.

FIG. 3A is a cross-sectional view of the preferred embodiment of the shifting and clutch mechanism, taken along the lines "3—3" in FIG. 2, looking down upon the elements of the shifting and clutch mechanism, and disclosing the convex shape of the faces of the triangular post, an extension of the tool-driving post.

FIG. 3B is a view of an alternate embodiment of the shifting and clutch mechanism, disclosing a flat or planar segment on the convex surfaces of the triangular post, upon which the roller moves when shifting between one of the two gripping positions.

DETAILED DESCRIPTION OF THE PRESENT INVENTION

FIGS. 1 and 2 disclose the shifting and detent mechanism 10 of the present invention. Convex surfaces 12*a*–12*c* of triangular post 14 (FIG. 3) mount thereon U-shaped fixtures 16*a*–16*c*, respectively, with their associated additional elements. Fixtures 16*a*–16*c* are pivotally mounted to convex faces 12*a*–12*c* by first pins 18*a*–18*c*, all respectively. Fixtures 16*a*–16*c* have in the lower corners thereof, notches 201 and 202, the functions of which are described hereinafter.

There are, preferably, three of mechanism 10 in each wrench. However, to avoid confusion and unnecessary redundancy, only one will be referred to in describing their structure and operation. If necessary to distinguish between them, the suffix "a", "b", or "c" will be added to the identifying numerals to keep them separate.

The pivotal mounting of fixtures 16*a*–16*c* permits them to be tilted to one side (or the other) as disclosed in FIG. 2.

Triangular post 14, as disclosed in FIG. 3, is rotatingly fastened to selector cap 22, which has second pin 24 protruding therefrom. Selector cap 22 also contains ball 26 resiliently mounted on spring 28 contained in cavity 30 formed in cap 22. Ball 26 presses against the lower surface 32 of cage 16.

Cap 22, second pin 24, ball 26, spring 28, and lower surface 32 of cage 16 comprise a detent mechanism whose operation and function will be explained hereinafter.

Cage 16 contains roller 34, having first end 36 and second end 38 thereof, as shown. First end 36 is oriented toward surface 40, and second end 38 rides on flat internal surface 42 of cage 16. First and second ends 36 and 38, respectively, can be flat or, preferably, rounded, so as to facilitate transition from one side of surface 42 to the other. Surface 44 is an inner radial planar surface of housing 46 formed at one end of wrench handle 48 to contain the shifting and detent mechanisms of the present invention, and surface 50 is an inner surface cylindrical about axis 52, which is also the axis of triangular post 14. Post 14 has fabricated at the other end thereof square post 54, upon which tools of traditional socket sets are removably mounted as needed.

Cap 22, post 14, cage 16, roller 34, convex surface 12, and cylindrical surface 50 comprise the shifting mechanism and novel friction drive of the present invention, as now to be explained more fully.

As cap 22 is rotated one way or the other, ball 26 will be shifted from one side of cage 16 to the other and, resiliently pressing upward against lower surface 48 thereof, tilting cage 16 from one side to the other. Pin 24 contacts cage 16 in one of notches 201 or 202, preventing further rotation of cap 22 in that direction (more precisely, when cap 22 is rotated clockwise, pin 24*a* will contact notch 20*a*1, pin 24*b* will contact notch 20*b*1, and pin 24*c* will contact notch 20*c*1; when cap 22 is rotated counter-clockwise, pin 24*a* will contact notch 20*c*2, pin 24*b* will contact notch 20*a*2, and pin 24*c* will contact notch 20*b*2). Lower surface 32 of cage 16 does not touch surface 22 of selector cap 22 at any time, so that a constant tension is exerted against roller 34 whichever position it is in.

By maintaining pressure on ball 26 against surface 32, spring 28 performs a detent function as ball 26 moves from one side of cage 16 to the other.

As cage 16 is tilted from one side to the other, second end 38 of roller 34 is resting against the "high" side of surface 42. However, first end 36 of roller 34 is brought into contact with cylindrical surface 50 converging toward convex surface 12 (FIG. 3A) or planar segment 13 (FIG. 3B), and forcing second end 38 to be moved, by lever action against tip 561 of cage 16 as a fulcrum, to the "low" side of surface 42. When roller 34 has been so moved, it is substantially parallel with axis 52 and is pressed intimately and frictionally between convex surface 12, or planar surface segment 13, and cylindrical surface 50. When handle 56, fabricated integrally with body 58 containing inner cylindrical surface 50, is rotated toward roller 34, friction wedges roller 34 tightly between surfaces 12 and 50, or surfaces 13 and 50, forcing triangular post 14 and square post 54 integral therewith, to move a socket tool (not shown) engaged with square post 54, against a resisting force in accordance therewith.

When selector 22 is rotated in the opposite direction to that just described, the same sequence of operations occurs, except that tip 542 of cage 16 acts as a fulcrum to move roller 34 in the opposite direction within cage 16, thereby realigning it with axis 52 but on the opposite side of planar surface 12 from its former operative position. It is again in intimate contact with convex surface 12 and cylindrical surface 50, or planar surface 13 and cylindrical surface 50, but in the opposite sense, and provides pressure to move a socket tool in the opposite direction.

It will be realized by those skilled in the art that there are several changes in structure that can be made without departing from the concepts disclosed here. For example, ball 26 and spring 28 could be replaced by other resilient means inserted between surface 22 and lower surface 32, e.g., a folded leaf spring with convex bumps formed in the surfaces in contact with surfaces 22 and 32. Any means of providing a constant and adequate pressure between the two surfaces is considered within the scope of the claims.

Further, fulcrum 561 and 562 preferably contact roller 34 at the midpoint thereof. However, there is a substantial range of positions different than the midpoint of roller 34 which would still give adequate pressure thereon to move it from side to side within cage 16.

The wrench will withstand approximately 20% more torque before failure than is required by ASME standards.

It will be realized by those skilled in the art that the shifting, frictional clutch, and detent mechanisms herein disclosed will be useful in more environments than with socket wrench sets. All such uses are contemplated to be covered hereby.

The terms and expressions which have been employed in the foregoing specification are used therein as terms of description and not of limitation, and there is no intention, in the use of such terms and expressions, of excluding equivalents of the features shown and described, or portions thereof, it being recognized that the scope of the invention is defined and limited only by the claims which follow.

What I claim as my invention is:

1. A reversible friction drive mechanism for socket wrenches and the like, including:

a] a body having a handle extending radially therefrom, first and second external faces on opposite sides of said body, an internal bearing surface therein being cylindrical about an axis normal to said first and second faces;

b] a rotatable member extending longitudinally along said axis and having thereon a tool-driving post extending externally along said axis from said second face, and a selector cap external to said body at said first face containing a detent mechanism, and rotatable between said first and second second selector positions independently of said tool-driving post;

c] said rotatable member having thereon at least one surface parallel to, but displaced radially from, said longitudinal axis, a substantially U-shaped fixture tiltably mounted on said surface with a base portion thereto, first and second arm portions extending substantially normally from said base portion with first and second fulcrum tips on the ends thereof, respectively, said fixture tilting between first and second operating positions as said selector cap is rotated between said first and second selector positions, respectively, said fixture loosely containing between said first and second fulcrum tips thereof a cylindrical roller, said roller being moved from a second position near said second arm portion, to a first position near said first arm portion, when said fixture is tilted from said second operating position to said first operating position, and from said first operating position to said second operating position, the improvement consisting essentially of:

1] said surface of said post having a convex shape parallel to said axis with a radius greater than the radius of said internal bearing surface, 2] said roller being frictionally engaged between and locked between said convex surface and said internal bearing surface when said handle is moved toward said bearing, and frictionally disengaged when said handle is moved away from said bearing.

2. The reversible friction drive mechanism of claim 1, wherein the movement of said cylindrical roller is one degree or less.

3. The reversible friction drive mechanism of claim 1, wherein the movement of said cylindrical roller is greater than one degree.

4. The reversible friction drive mechanism of claim 1, wherein said cylindrically convex surface has, on the portion of said convex surface most distant from said internal bearing surface, a flat portion upon which said cylindrical roller moves from side to side of said convex surface, as said fixture is tilted from said first operating position of said convex surface to said second operating position, and from said second operating position of said convex surface to said first operating position.

* * * * *